US007332132B2

(12) United States Patent
Hedrick et al.

(10) Patent No.: US 7,332,132 B2
(45) Date of Patent: Feb. 19, 2008

(54) STRIPPING APPARATUS AND PROCESS

(75) Inventors: Brian W. Hedrick, Rolling Meadows, IL (US); Zhanping Xu, Amherst, NY (US); Paolo Palmas, Des Plaines, IL (US); Mitchell J. Kowalczyk, Brookfield, IL (US); Matthew J. Westby, Chicago, IL (US); Weikai Gu, Mount Prospect, IL (US); J. Mark Houdek, Bartlett, IL (US); Daniel R. Monkelbaan, Amherst, NY (US)

(73) Assignee: UOP LLC, Des Plaines, IL (US)

( * ) Notice: Subject to any disclaimer, the term of this patent is extended or adjusted under 35 U.S.C. 154(b) by 672 days.

(21) Appl. No.: 10/804,283

(22) Filed: Mar. 19, 2004

(65) Prior Publication Data

US 2005/0205467 A1 Sep. 22, 2005

(51) Int. Cl.
*B32B 5/02* (2006.01)
*B32B 27/04* (2006.01)

(52) U.S. Cl. ..... 422/144; 422/145; 422/147

(58) Field of Classification Search ..... 422/144, 422/145, 147
See application file for complete search history.

(56) References Cited

U.S. PATENT DOCUMENTS

| | | | | |
|---|---|---|---|---|
| 2,047,444 | A | 7/1936 | Stedman | 261/94 |
| 4,220,623 | A | 9/1980 | Jahnke et al. | 422/144 |
| 4,323,446 | A * | 4/1982 | Chervenak et al. | 208/410 |
| 4,364,905 | A | 12/1982 | Fahrig et al. | 422/144 |
| 4,419,221 | A | 12/1983 | Castagnos, Jr. et al. | 208/113 |
| 4,431,749 | A | 2/1984 | Hettinger, Jr. et al. | 502/68 |
| 4,481,103 | A | 11/1984 | Krambeck et al. | 208/120 |
| 4,497,753 | A * | 2/1985 | Streiff | 261/95 |
| 4,541,922 | A | 9/1985 | Lomas et al. | 208/164 |
| 4,541,923 | A | 9/1985 | Lomas et al. | 208/164 |
| 4,950,430 | A | 8/1990 | Chen et al. | 261/112.2 |
| 5,656,243 | A * | 8/1997 | Luckenbach et al. | 585/484 |
| 5,716,585 | A * | 2/1998 | Senegas et al. | 422/144 |
| 6,224,833 | B1 | 5/2001 | Rall | 422/143 |
| 6,244,833 | B1 * | 6/2001 | Hettinger | 417/282 |
| 6,409,378 | B1 * | 6/2002 | Kessler | 366/337 |
| 6,680,030 | B2 | 1/2004 | Koebel et al. | 422/144 |
| 7,179,427 | B2 * | 2/2007 | Marchant et al. | 422/144 |
| 2005/0040075 | A1 * | 2/2005 | Cerqueira et al. | 208/113 |
| 2005/0258557 | A1 * | 11/2005 | Davis et al. | 261/94 |

FOREIGN PATENT DOCUMENTS

EP 0 850 687 A2 7/1998

OTHER PUBLICATIONS

Product sheet entitled "Support Plate Cross-Flow-Grid Type SP-CF".

* cited by examiner

*Primary Examiner*—N. Bhat
(74) *Attorney, Agent, or Firm*—James C Paschall

(57) ABSTRACT

An apparatus and process for stripping gases from solids comprises a structured packing in a stripping section of a vessel. The structured packing comprises a plurality of corrugated ribbons with each corrugated ribbon having at least two faces angular to each other. The ribbons at least partially obstruct passage of the solid particles. Edges of adjacent ribbons defining openings for the passage of contacted particles.

12 Claims, 11 Drawing Sheets

STRIPPING APPARATUS AND PROCESS

BACKGROUND OF THE INVENTION

This invention relates to processes and apparatus for the fluidized contacting of catalyst with hydrocarbons. More specifically, this invention relates to an apparatus and process for stripping entrained or adsorbed hydrocarbons from catalyst particles.

DESCRIPTION OF THE PRIOR ART

A variety of processes contact finely divided particulate material with a hydrocarbon containing feed under conditions wherein a fluid maintains the particles in a fluidized condition to effect transport of the solid particles to different stages of the process. Fluid catalytic cracking (FCC) is a prime example of such a process that contacts hydrocarbons in a reaction zone with a catalyst composed of finely divided particulate material. The hydrocarbon feed fluidizes the catalyst and typically transports it in a riser as the catalyst promotes the cracking reaction. As the cracking reaction proceeds, substantial amounts of hydrocarbon, called coke, are deposited on the catalyst. A high temperature regeneration within a regeneration zone burns coke from the catalyst by contact with an oxygen-containing stream that again serves as a fluidization medium. Coke-containing catalyst, referred to herein as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone.

A majority of the hydrocarbon vapors that contact the catalyst in the reaction zone are separated from the solid particles by ballistic and/or centrifugal separation methods within the reaction zone. However, the catalyst particles employed in an FCC process have a large surface area, which is due to a great multitude of pores located in the particles. As a result, the catalytic materials retain hydrocarbons within their pores, upon the external surface of the catalyst and in the spaces between individual catalyst particles as they enter the stripping zone. Although the quantity of hydrocarbons retained on each individual catalyst particle is very small, the large amount of catalyst and the high catalyst circulation rate which is typically used in a modern FCC process results in a significant quantity of hydrocarbons being withdrawn from the reaction zone with the catalyst.

Therefore, it is common practice to remove, or strip, hydrocarbons from spent catalyst prior to passing it into the regeneration zone. Improved stripping brings economic benefits to the FCC process by reducing "delta coke". Delta coke is the weight percent coke on spent catalyst less the weight percent coke on regenerated catalyst. Reducing delta coke in the FCC process causes a lowering of the regenerator temperature. Consequently, more of the resulting, relatively cooler regenerated catalyst is required to supply the fixed heat load in the reaction zone. The reaction zone may hence operate at a higher catalyst-to-feed or catalyst-to-oil (C/O) ratio. The higher C/O ratio increases conversion which increases the production of valuable products. Accordingly, improved stripping results in improved conversion.

The most common method of stripping the catalyst passes a stripping gas, usually steam, through a flowing stream of catalyst, counter-current to its direction of flow. Such steam stripping operations, with varying degrees of efficiency, remove the hydrocarbon vapors which are entrained with the catalyst and adsorbed on the catalyst. Contact of the catalyst with a stripping medium may be accomplished in a simple open vessel as demonstrated by U.S. Pat. No. 4,481,103 or with a riser reactor ascending through the stripping vessel.

The efficiency of catalyst stripping is typically increased by using vertically spaced baffles to cascade the catalyst from side to side as it moves down a stripping apparatus and counter-currently contacts a stripping medium. Moving the catalyst horizontally increases both residence time and contact between the catalyst and the stripping medium so that more hydrocarbons are removed from the catalyst. In these arrangements, the catalyst and stripping gas travel a labyrinthine path through a series of baffles located at different levels to effect two-phase mixing. Catalyst and gas contact is increased by this arrangement that leaves no open vertical path of significant cross-section through the stripping apparatus. U.S. Pat. No. 4,364,905 shows an example of a stripping device for an FCC unit that includes a series of outer baffles in the form of frusto-conical sections that direct the catalyst inwardly onto a series of inner baffles. The inner baffles are centrally located conical or frusto-conical sections that divert the catalyst outwardly onto the outer baffles. The stripping medium enters from below the lower baffles and continues rising upwardly from the bottom of one baffle to the bottom of the next succeeding baffle. U.S. Pat. No. 6,680,030 B2 discloses a stripping device with horizontal baffles comprising grates and downcomers.

U.S. Pat. No. 5,716,585 discloses utilizing a structured packing comprising stacked corrugated plates to facilitate contacting of catalyst and stripping medium in a stripping device. U.S. Pat. No. 6,224,833 B1 also discloses a stripping device with a structured packing comprising slotted planar portions intersecting each other. A product sheet entitled "Support Plate Cross-Flow-Grid Type SP-CF" shows a grid for supporting a packed bed above the grid in a distillation or absorption column in which gas and liquid are phase components.

Byproduct coke in FCC units have been known to accumulate in relatively unfluidized zones to spall off in large pieces during abrupt changes in conditions to clog narrow flow channels. Hence, structured packings in an FCC unit with narrow flow channels would increase the risk of such clogging. Moreover, structured packings must be uniformly distributed within the volume of the stripping vessel. Otherwise, poor distribution of catalyst and stripping gas flow may generate non-uniform vapor-solids contact which can diminish stripping performance. Uniformly installing structured packings with intersecting planar members in stripping devices with round inner walls can be difficult requiring intense labor.

The efficiency of a stripper can be compared to models to gauge relative performance. A perfect counter-current stripper is modeled to operate with hydrocarbon laden catalyst phase flowing down into the stripper, stripping gas flowing up into the stripper, a catalyst phase stripped of all hydrocarbons and laden with all of the steam flowing down out of the stripper and hydrocarbon flowing up out the stripper. The perfect counter-current stripper operates such that just enough stripping gas to fluidize the catalyst is sufficient to displace all of the hydrocarbon on the catalyst. The stripped hydrocarbon rises in the stripper to the top outlet and the stripping gas on the catalyst descends with the catalyst to exit the bottom. Therefore, the theoretical amount of stripping gas for a perfect counter-current stripper model becomes the low limitation for design of a stripper. The solid straight line in FIGS. 1-3 represent the calculated perfect counter-current stripper performance.

Another way of evaluating stripper performance is through the use of a counter-current backmixed stages model. This model treats the stripper as divided into discrete stages. The gas in the catalyst phase descending into a stage is well mixed with gas rising from the previous stage. Gas descending and rising into a stage including both stripped hydrocarbons and stripping gas equilibrates to a stage gas composition. The gas in the stage with the stage gas composition then descends with the catalyst phase leaving the stage. The excess gas not required to fluidize the catalyst phase rises with the same stage gas composition to the next higher stage. The counter-current backmixed stages model can be used to predict the effect of stripping gas rates and number of stages on overall stripping performance. FIGS. 1-3 shows the calculated performance for a backmixed-stages model based on seven stages by the dashed line. Conventional baffle stripping vessels typically have seven stages. Greater numbers of stages and/or stripping gas rates would bring the performance of the backmixed-stages model closer to the perfect counter-current performance represented by the straight line in FIGS. 1-3.

Accordingly, it is an object of this invention to provide a structured packing for a stripping device that provides high efficiency stripping and minimizes the risk of clogging.

It is an additional object of this invention to provide a structured packing that provides high efficiency stripping and can be easily assembled into a stripping vessel.

BRIEF SUMMARY OF THE INVENTION

It has now been found that providing a structural packing comprising ribbons with angular bands and openings between adjacent edges to allow catalyst flow can be uniformly installed into a stripping vessel with relatively small occasion of clogging by spalling coke deposits. The structural packing of the present invention can be installed in a stripping vessel with or without an internal riser. We have found that the structural packing of the present invention can provide stripping performance very close to ideal stripping models.

Additional objects, embodiments, and details of this invention are given in the following detailed description of the invention.

DETAILED DESCRIPTION OF THE INVENTION

Figure 1:
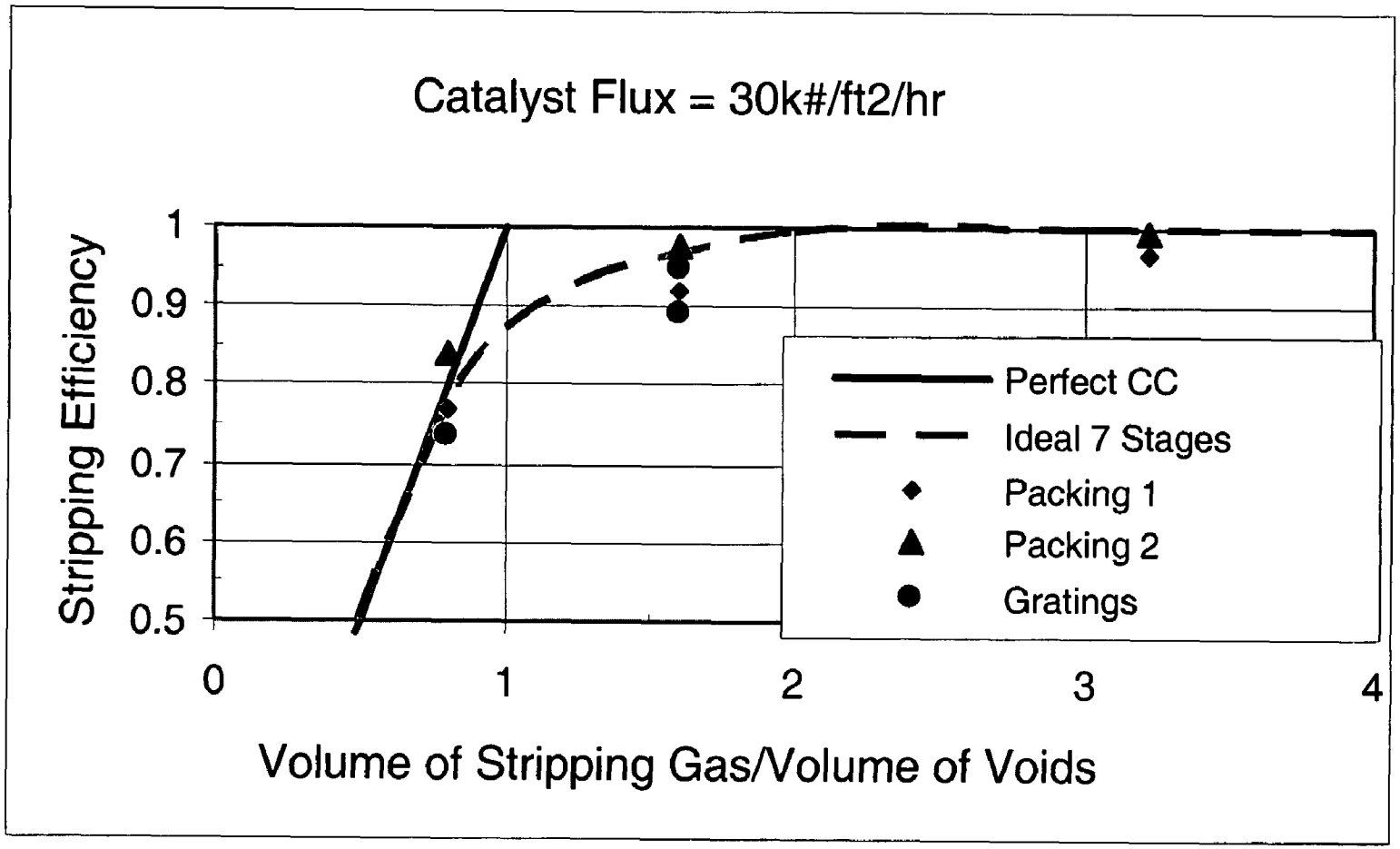
FIGS. 1-3 are plots showing stripping efficiencies of the present invention for varied catalyst fluxes.

Looking first at a more complete description of the FCC process, the typical feed to an FCC unit is a gas oil such as a light or vacuum gas oil. Other petroleum-derived feed streams to an FCC unit may comprise a diesel boiling range mixture of hydrocarbons or heavier hydrocarbons such as reduced crude oils. It is preferred that the feed stream consists of a mixture of hydrocarbons having boiling points, as determined by the appropriate ASTM test method, above about 230° C. (446° F.) and more preferably above about 290° C. (554° F.).

An FCC process unit comprises a reaction zone and a catalyst regeneration zone. In the reaction zone, a feed stream is contacted with a finely divided fluidized catalyst maintained at an elevated temperature and at a moderate positive pressure. In this invention, contacting of feed and catalyst usually takes place in a riser conduit, but may occur in any effective arrangement such as the known devices for short contact time contacting. In the case of a riser, it comprises a principally vertical conduit as the main reaction site, with the effluent of the conduit emptying into a large volume process vessel containing a solids-vapor separation device. The products of the reaction are separated from a portion of catalyst which falls downwardly. A stripper is usually receives the spent catalyst to remove hydrocarbons from the catalyst. Catalyst is transferred to a separate regeneration zone after it passes through the stripping apparatus.

The rate of conversion of the feedstock within the reaction zone is controlled by regulation of the temperature, activity of the catalyst, and quantity of the catalyst relative to the feed (C/O ratio) maintained within the reaction zone. The most common method of regulating the temperature in the reaction zone is by regulating the rate of circulation of catalyst from the regeneration zone to the reaction zone, which simultaneously changes the C/O ratio. That is, if it is desired to increase the conversion rate within the reaction zone, the rate of flow of catalyst from the regeneration zone to the reaction zone is increased. This results in more catalyst being present in the reaction zone for the same volume of oil charged thereto. Since the temperature within the regeneration zone under normal operations is considerably higher than the temperature within the reaction zone, an increase in the rate of circulation of catalyst from the regeneration zone to the reaction zone results in an increase in the reaction zone temperature.

The chemical composition and structure of the feed to an FCC unit will affect the amount of coke deposited upon the catalyst in the reaction zone. Normally, the higher the molecular weight, Conradson carbon, heptane insolubles, and carbon-to-hydrogen ratio of the feedstock, the higher will be the coke level on the spent catalyst. Also, high levels of combined nitrogen, such as found in shale-derived oils, will increase the coke level on spent catalyst. Processing of heavier feedstocks, such as deasphalted oils or atmospheric bottoms from a crude oil fractionation unit (commonly referred to as reduced crude) results in an increase in some or all of these factors and therefore causes an increase in the coke level on spent catalyst.

The reaction zone, which is normally referred to as a "riser" due to the widespread use of a vertical tubular conduit, is maintained at high temperature conditions which generally include a temperature above about 425° C. (797° F.). Preferably, the reaction zone is maintained at cracking conditions which include a temperature of from about 480° C. (896° F.) to about 590° C. (1094° F.) and a pressure of from about 65 to 500 kPa (9.4 to 72.5 psia) but preferably less than about 275 kPa (39.9 psia). The C/O ratio, based on the weight of catalyst and feed hydrocarbons entering the bottom of the riser, may range up to 20:1 but is preferably between about 4:1 and about 10:1. Hydrogen is not normally added to the riser, although hydrogen addition is known in the art. On occasion, steam may be passed into the riser. The average residence time of catalyst in the riser is preferably less than about 5 seconds. The type of catalyst employed in the process may be chosen from a variety of commercially available catalysts. A catalyst comprising a zeolite base material is preferred, but the older style amorphous catalyst can be used if desired. Further information on the operation of FCC reaction zones may be obtained from U.S. Pat. No. 4,541,922, U.S. Pat. No. 4,541,923 and the patents cited above.

In an FCC process, catalyst is continuously circulated from the reaction zone to the regeneration zone and then again to the reaction zone. The catalyst therefore acts as a vehicle for the transfer of heat from zone to zone as well as providing the necessary catalytic activity. Any FCC catalyst can be used for the process. The particles will typically have a size of less than 100 microns. Catalyst which is being withdrawn from the regeneration zone is referred to as "regenerated" catalyst. As previously described, the catalyst charged to the regeneration zone is brought into contact with an oxygen-containing gas such as air or oxygen-enriched air under conditions which result in combustion of the coke. This results in an increase in the temperature of the catalyst and the generation of a large amount of hot gas which is removed from the regeneration zone as a gas stream referred to as a flue gas stream. The regeneration zone is normally operated at a temperature of from about 600° C. (1112° F.) to about 800° C. (1472° F.). Additional information on the operation of FCC reaction and regeneration zones may be obtained from U.S. Pat. No. 4,431,749, U.S. Pat. No. 4,419,221 (cited above) and U.S. Pat. No. 4,220,623.

The catalyst regeneration zone is preferably operated at a pressure of from about 35 to 500 kPa (5.1 to 72.5 psia). The spent catalyst being charged to the regeneration zone may contain from about 0.2 to about 2.0 wt-% coke. This coke is predominantly comprised of carbon and can contain from about 3 to 12 wt-% hydrogen, as well as sulfur and other elements. The oxidation of coke will produce the common combustion products: carbon dioxide, carbon monoxide, and water. As known to those skilled in the art, the regeneration zone may take several configurations, with regeneration being performed in one or more stages. Further variety is possible due to the fact that regeneration may be accomplished with the fluidized catalyst being present as either a dilute phase or a dense phase within the regeneration zone. The term "dilute phase" is intended to indicate a catalyst/gas mixture having a density of less than 300 kg/m$^3$ (18.7 lb/ft$^3$). In a similar manner, the term "dense phase" is intended to mean that the catalyst/gas mixture has a density equal to or more than 300 kg/m$^3$ (18.7 lb/ft$^3$). Representative dilute phase operating conditions often include a catalyst/gas mixture having a density of about 15 to 150 kg/m3 (0.9 to 9.4 lb/ft$^3$).

Figure 4:
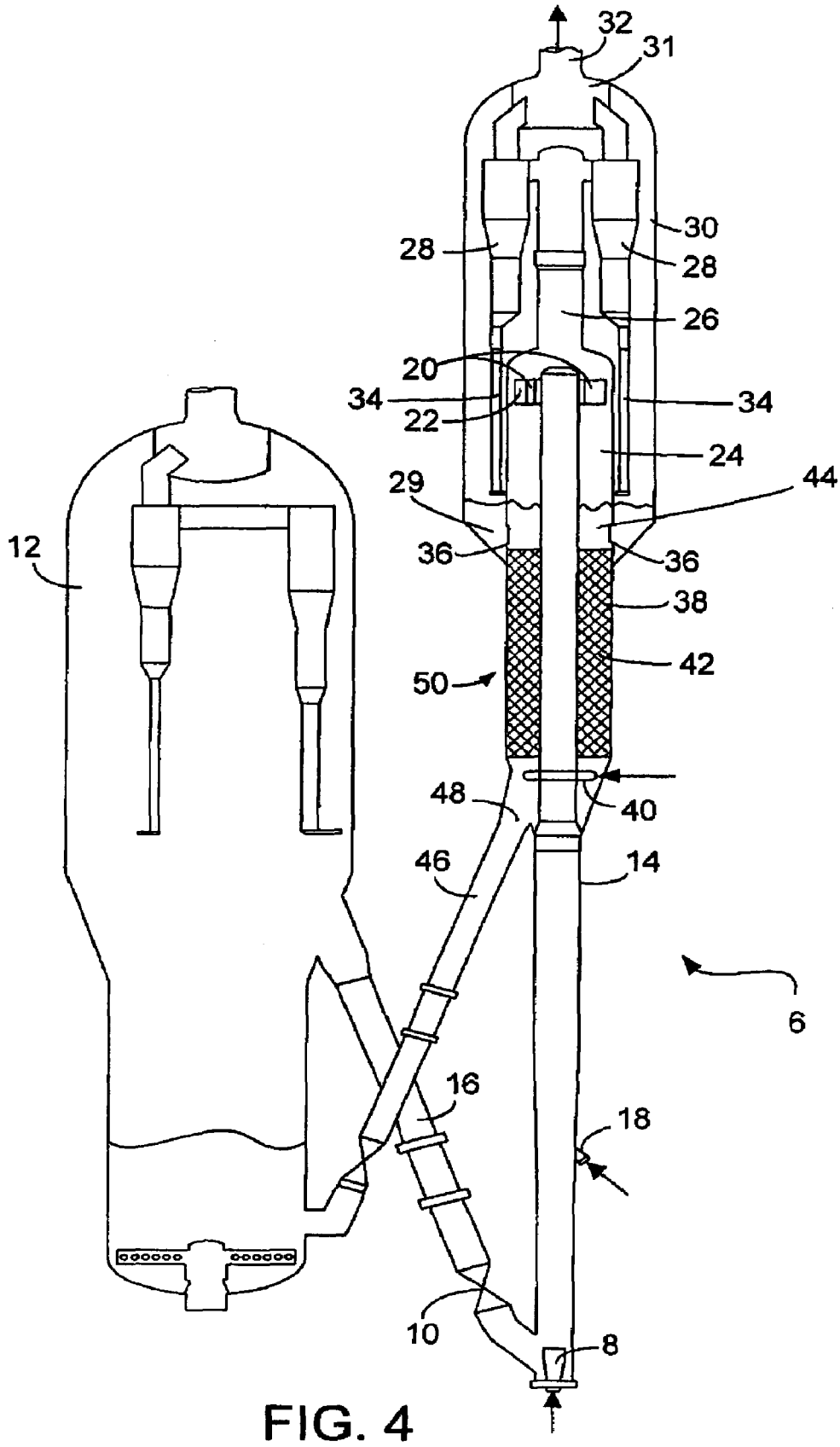
FIG. 4 shows a sectional elevation view of an FCC reactor and stripper arrangement in which the present invention may be incorporated.

FIG. 4 shows an FCC unit 6 to which the process and apparatus of this invention may be applied. The FCC unit in FIG. 4 represents only one of many FCC arrangements to which this invention can be applied. Looking then at FIG. 4, a regenerator standpipe 16 transfers catalyst from a regenerator 12 at a rate regulated by a slide valve 10. A fluidization medium from a nozzle 8 transports catalyst upwardly through a lower portion of a riser 14 at a relatively high density until a plurality of feed injection nozzles 18 (only one is shown) inject feed across the flowing stream of catalyst particles. The resulting mixture continues upward through an upper portion of the riser 14 until at least two disengaging arms 20 tangentially discharge the mixture of gas and catalyst through openings 22 from a top of the riser 14 into a disengaging vessel 24 that effects separation of gases from the catalyst. Most of the catalyst discharged from openings 22 fall downwardly in the disengaging vessel 24 into a bed 44. A transport conduit 26 carries the separated hydrocarbon vapors with entrained catalyst to one or more cyclones 28 in a reactor or separator vessel 30. The cyclones 28 separate spent catalyst from the hydrocarbon vapor stream. A collection chamber 31 gathers the separated hydrocarbon vapor streams from the cyclones for passage to an outlet nozzle 32 and into a downstream fractionation zone (not shown). Diplegs 34 discharge catalyst from the cyclones 28 into a bed 29 in a lower portion of the disengaging vessel 24 which pass through ports 36 into the bed 44 in the disengaging vessel 24. Catalyst and adsorbed or entrained hydrocarbons pass from the disengaging vessel 24 into a stripping section 38 across ports 36. Catalyst from openings 22 separated in the disengaging vessel 24 passes directly into the stripping section 38. Hence, entrances to the stripping section 38 include openings 22 and ports 36. Stripping gas such as steam enters a lower portion of the stripping section 38 through a distributor 40 and rises counter-current to a downward flow of catalyst through the stripping section 38, thereby removing adsorbed and entrained hydrocarbons from the catalyst which flow upwardly through and are ultimately recovered with the steam by the cyclones 28. The distributor 40 distributes the stripping gas around the circumference of the stripping section 38. In order to facilitate hydrocarbon removal, a structured packing 50 comprising ribbons 42 are provided in the stripping section 38. The spent catalyst leaves the stripping section 38 through a port 48 to a reactor conduit 46 and passes into the regenerator 12. The catalyst is regenerated in the regenerator 12 as is known in the art and sent back to the riser 14 through the regenerator standpipe 16.

Figure 5:
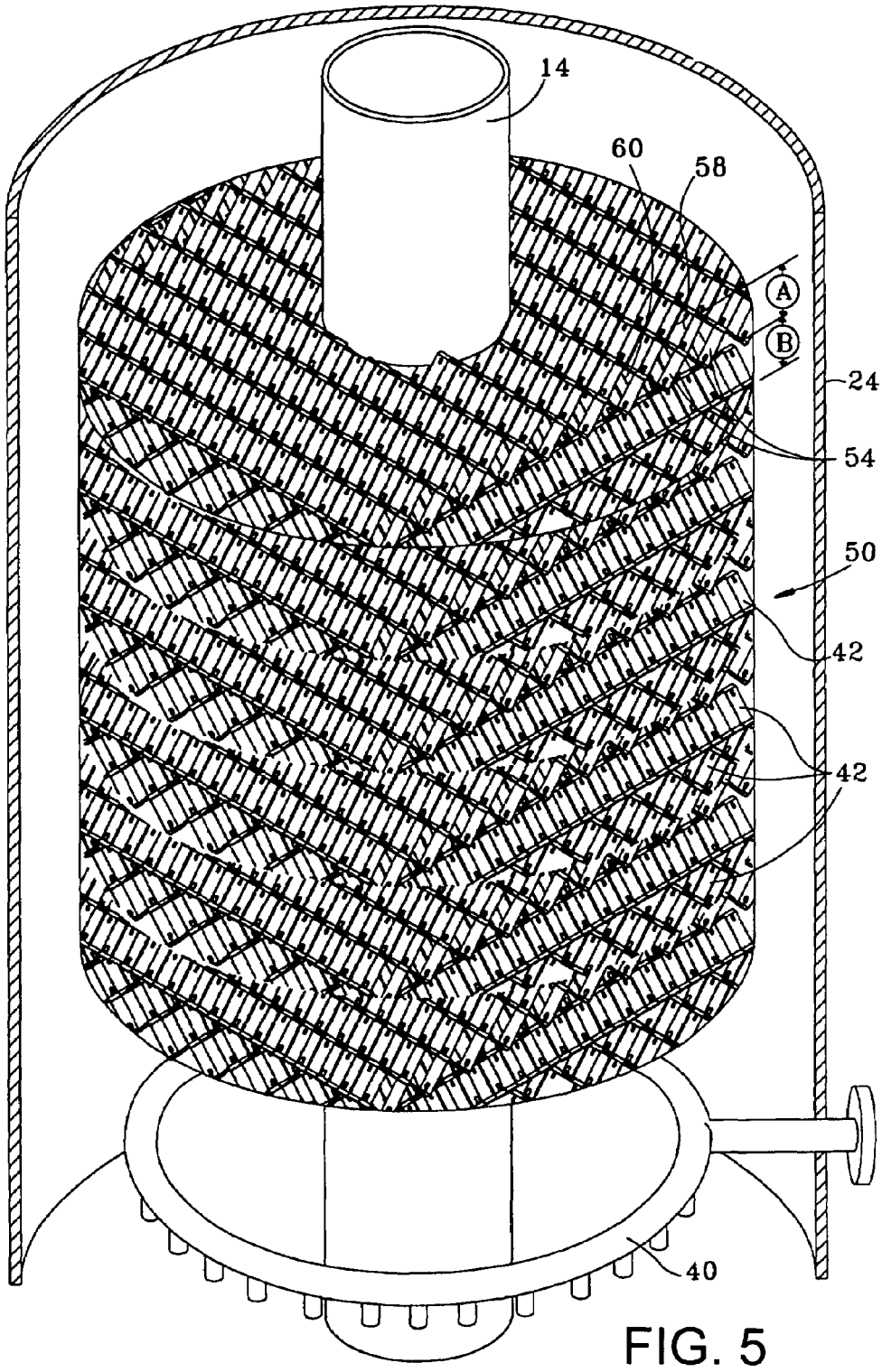
FIG. 5 is an enlarged perspective view of the stripper section taken from FIG. 4 showing a first embodiment.

FIG. 5 is an enlarged perspective view of the stripping section 38 of disengaging vessel 24 of FIG. 4. Although the stripping section 38 is shown to have the riser 14 ascending through it, the invention is applicable to stripping sections without an internal riser. The stripping section 38 contains the structured packing 50 of corrugated ribbons 42. Corrugated ribbons refers to metal strips formed with at least two bands 54 angular to or uncoplanar with each other. To form corrugations, bands 54 may be bent or formed relative to each other or separate pieces may be fixed to each other such as by welding to define joints between bands. The ribbons 42 partially obstruct downward passage of catalyst particles and upward passage of gas. Preferably, bands 54 are disposed to obstruct passage of gas and catalyst. Adjacent ribbons 42 have edges 58 that define openings 60 to allow passage of catalyst particles and gases. The distributor 40 for distributing stripping gas is disposed below the structural packing 50. The ribbons 42 are arranged in arrays and one or more arrays of ribbons 42 define layers A, B. Layers A, B may be stacked upon each other and may be oriented differently. In FIG. 5, layers A and B are oriented at 90° to each other. Outer circumferential edges of the packing 50 are sheared or formed to conform to the inner circumference of the stripping section 38 of the disengaging vessel 24.

Figure 6:
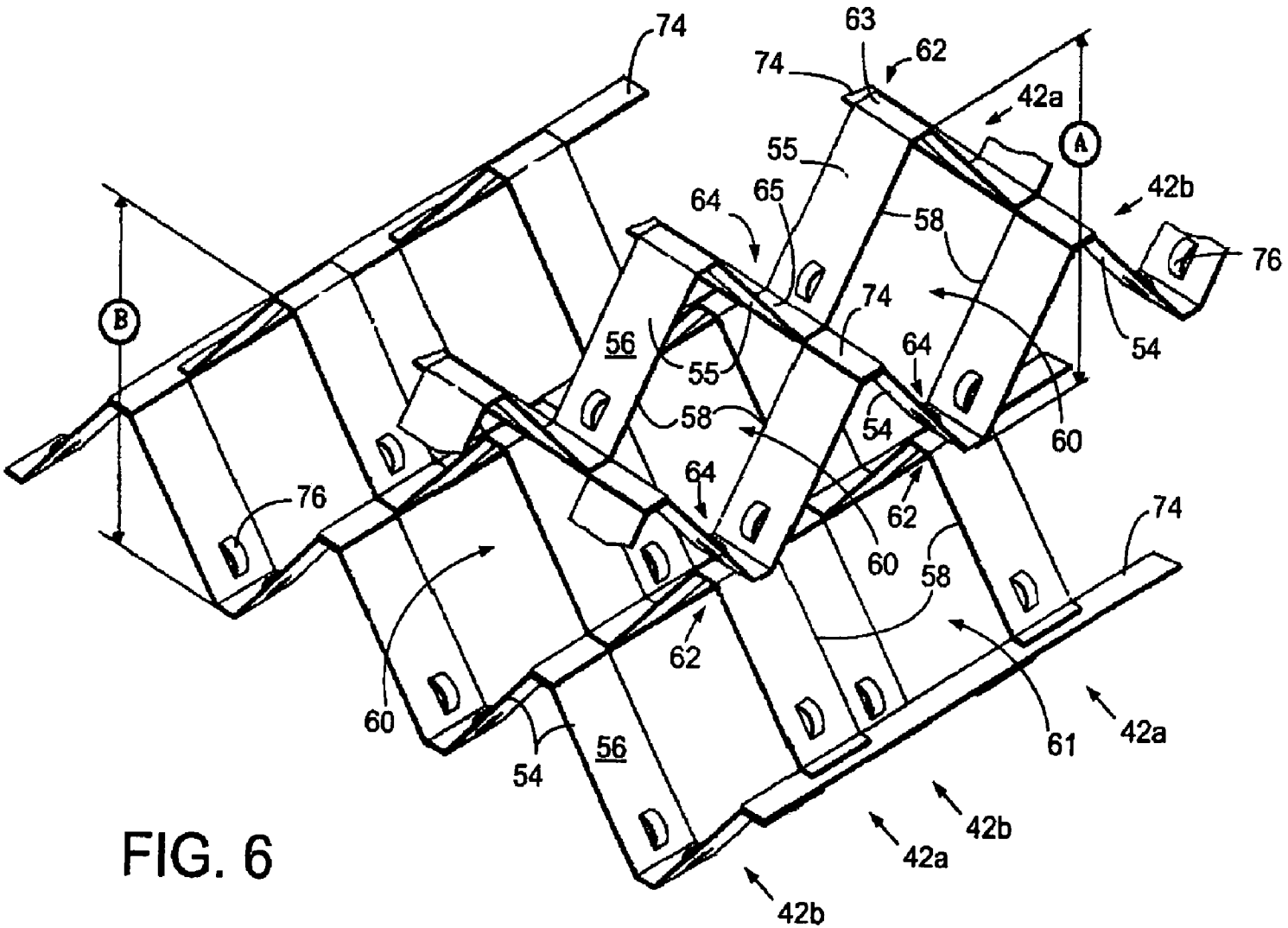
FIG. 6 is an enlarged partial perspective view of structured packing in the stripper section of FIG. 5.
Figure 7:
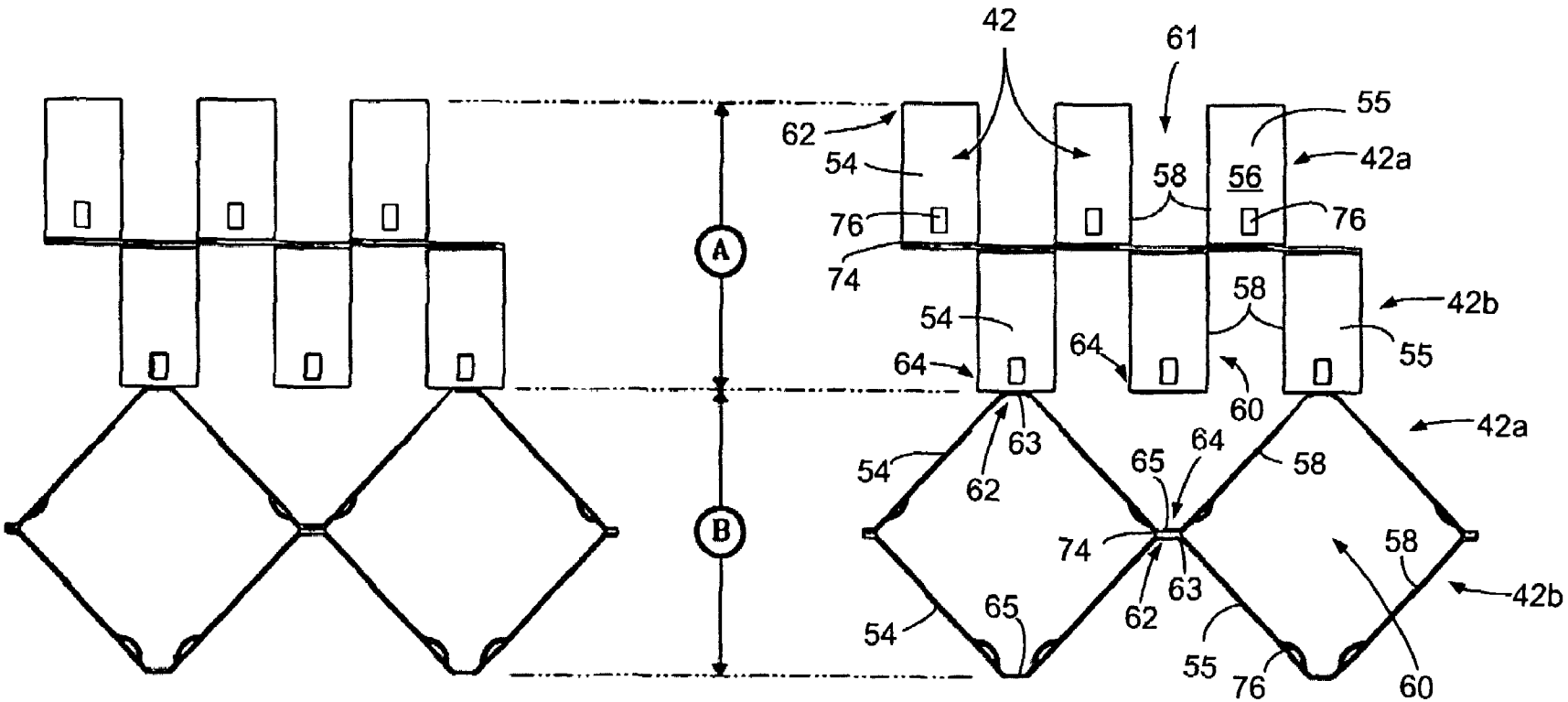
FIG. 7 is an enlarged partial elevational view of the structured packing in the stripper section of FIG. 5.

An enlarged view of two layers A, B of the structural packing 50 of FIG. 5 is shown in a perspective view in FIG. 6 and in an elevational view in FIG. 7. Each ribbon 42 comprises bands 54 configured in undulating peaks 62 and valleys 64. Each band 54 includes a face 56 that obstructs passage of fluid and catalyst. In the embodiment of FIGS. 6 and 7, the bands 54 include laterals 55 arranged to provide peaks 62 at an upper landing 63 and valleys 64 at a lower landing 65, but the peaks 62 and valleys 64 may be provided at the apex of a joint of just two bands 54. The layers A, B each include paired ribbons 42*a*, 42*b*. The lower landings 65 in upper ribbon 42*a* meet the upper landings 63 of lower ribbon 42*b*. A stabilizing strip 74 is disposed between upper landing 63 and lower landing 65. If paired ribbons 42*a*, 42*b* are cut out of a common piece of metal, a stabilizing strip 74 may be obviated. Ribbon 42*a* is disposed at a phase that is 180° out of phase to the phase of paired ribbon 42*b*. Other phase relationships may be used. Moreover, the axial spacing of a ribbon 42*a* is offset from the axial spacing of its paired ribbon 42*b*. Consequently, edges 58 of ribbon 42*a* and edges 58 of ribbon 42*b* may be parallel and may define a plane therebetween. The edges 58 of the laterals 55 and landings 63, 65 in ribbon 42*a* and the edges 58 of the laterals 55 and landings 63, 65 in ribbon 42*b* define openings 60 for the horizontal passage of fluid and catalyst. Edges of laterals 55 and landings 63, 65 in alternating upper ribbons 42*a* and alternating lower ribbons 42*b* define openings 61 for the vertical passage of fluid and catalyst. These openings 60, 61 are also defined by the faces 56 of the laterals 55 and upper and lower landings 63, 65. Dimples 76 may be provided in bands 54. Although shown in laterals 55 near valleys 64, the dimples 76 may be disposed in lower landings 65. It is also contemplated that edges 58 of laterals 55 may be secured to each other in which case laterals 55 would cross each other. Moreover, although the ribbons 42 are preferably stacked horizontally in the stripping section 38, the ribbons 42 may be arranged vertically in the stripping section 38. FIGS. 6 and 7 show valleys 64 of lower ribbons 42*b* in layer A stacked on peaks 62 of upper ribbons 42*a* in layer B.

FIGS. 8-12 show an alternative embodiment of a structured packing 50' that can be used in the stripping section 38 of FIG. 4. All of the reference numerals that designate an element in FIGS. 8-12 that corresponds to a similar element in FIGS. 5-7 but have a different configuration will be marked with a prime symbol (').  Otherwise, the same reference numeral will designate corresponding elements in FIGS. 5-7 and 8-10 that have the same configuration.

Figure 8:
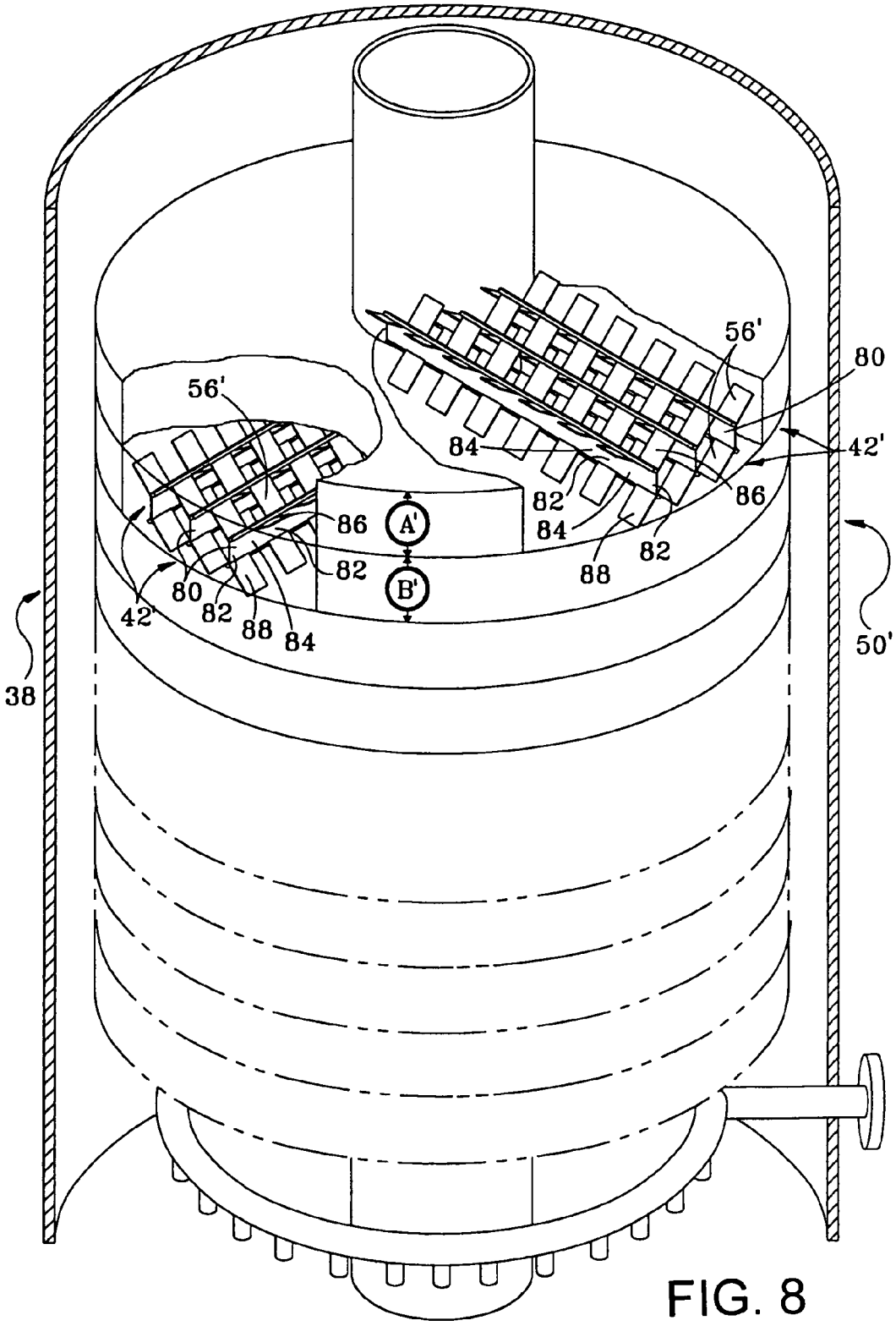
FIG. 8 is an enlarged perspective view of the stripper section taken from FIG. 4 showing a second embodiment.

FIG. 8 shows a perspective view of a structural packing 50' that corresponds to FIG. 5. Each ribbon 42' includes a standard strip 80 comprising alternating segments 82, 84 each with an upper tab 86 and a lower tab 88 projecting in alternating directions. Tabs 86, 88 and standard strip 80 define faces 56'. Faces 56' of tabs 86, 88 and strip 80 obstruct the passage of stripping gas and catalyst. Adjacent ribbons 42' are arranged together in an array to define layers A', B'. Preferably, upper and lower tabs 86, 88 of a given segment 82, 84 are parallel to each other, and standard strips 80 in the same layer A', B' are arranged in parallel. Layers A' and B' are stacked on top of each other in the stripping section and may be oriented differently. FIG. 8 shows the layers A' and B' perpendicular to each other.

Figure 9:
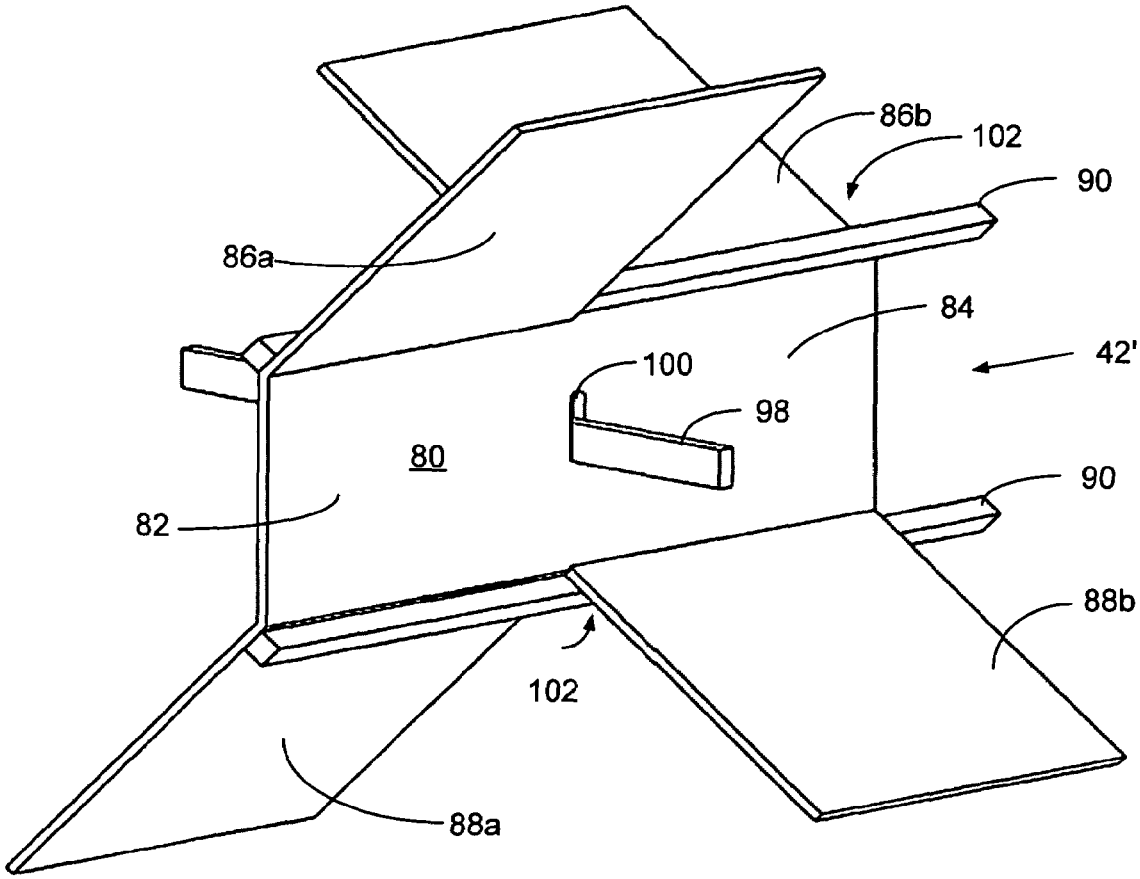
FIG. 9 is a partial perspective view of two segments of structured packing shown in FIG. 8.

FIG. 9 is an enlarged partial perspective view of two segments 82, 84 of one ribbon 42' of FIG. 8. Upper tabs 86*a*, 86*b* of adjacent segments 82, 84, respectively, project from the standard strip 80 and may have opposite configurations and be angular to each other. Lower tabs 88*a*, 88*b* of adjacent segments 82, 84, respectively, project from standard strip 80 and may have opposite configurations and be angular to each other. Tie rods 98 extend through apertures 100 in standard strip 80 to secure ribbons 42' in an array. The tie rod 98 may be welded to the standard strip 80. Stabilizing strips 90 are seated in and secured to troughs 102 defined by upper tabs 86*a*, 86*b* and lower tabs 88*a*, 88*b* of adjacent segments 82, 84.

Figure 10:
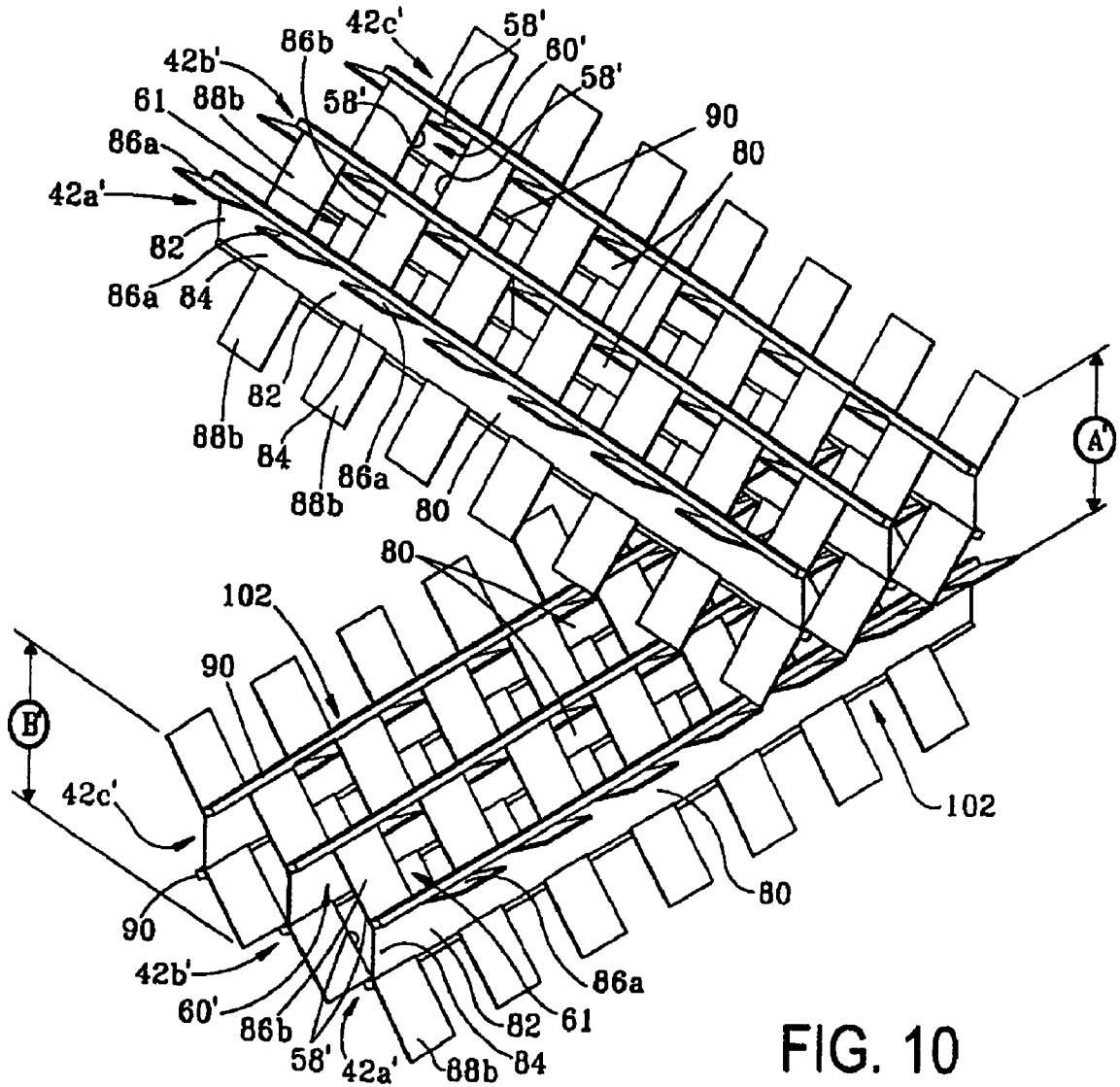
FIG. 10 is a partial perspective view of two layers of structured packing shown in FIG. 8.

FIG. 10 is a partial perspective view of two layers A' and B' each with three ribbons 42*a*', 42*b*' and 42*c*' of FIG. 8. Upper tabs 86*a* and lower tabs 88*a* (not visible in FIG. 10) of alternating segments 82, 82 and upper tabs 86*b* and lower tabs 88*b* of alternating segments 84, 84 may have similar or identical configurations. Upper tabs 86*a*, 86*b* and lower tabs 88*a*, 88*b* of aligned segments 82, 84 of adjacent ribbons 42*a*', 42*b*', 42*c*' project from standard strips 80 parallel to each other. Edges 58' of upper tabs 86*a*, 86*b* and lower tabs 88*a*, 88*b* of cater-cornered segments 82, 84 of adjacent ribbons 42*a*', 42*b*', 42*c*' that converge are offset from each other and define openings 60'for the horizontal passage of stripping fluid and catalyst. Moreover edges 58' of upper tabs 86*a*, 86*b* and lower tabs 88*a*, 88*b* of alternating segments 82, 82 and 84, 84 of the same ribbons 42*a*', 42*b*', 42*c*' define openings 61 for the vertical passage of stripping fluid and catalyst. These openings 60', 61 are also defined by the faces 56' of the upper and lower tabs 86*a*, 86*b*, 88*a*, 88*b* and standard strips 80. Stabilizing strips 90 are nested in troughs 102 defined by upper tabs 86 and lower tabs 88 of ribbons 42*a*', 42*b*', 42*c*' and secured therein for purposes of stability. Moreover, the dimension of the stabilizing strip can be varied to adjust the degree of obstruction to fluid flow. In other words, the dimension of the strip is inversely proportional to the dimension of the openings 61. Smaller dimensions of openings 61 allow only smaller bubbles of stripping gas to ascend in the stripping section 38, thereby facilitating mass transfer of the gas in bubbles to strip the catalyst. The stabilizing strip 90 may have a diamond profile. Other profiles for the stabilizing strip are contemplated.

Figure 11:
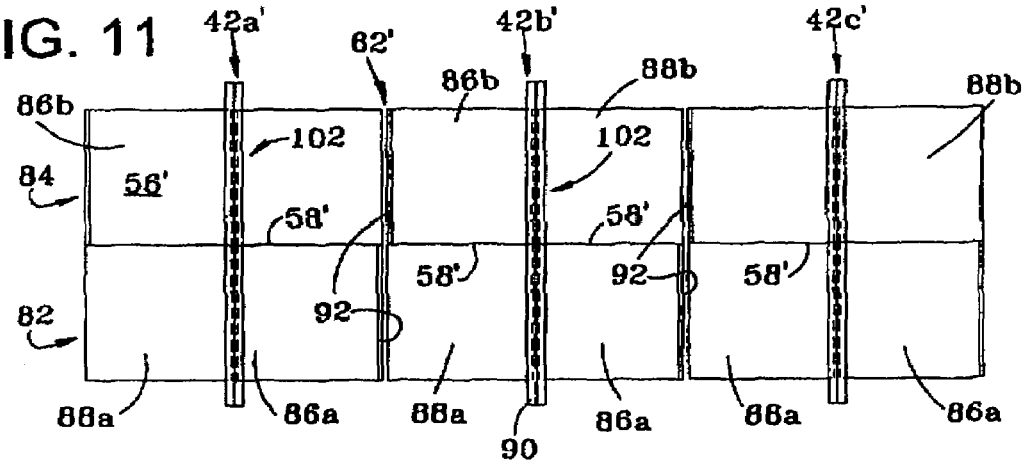
FIG. 11 is a top plan partial view of the structured packing in FIG. 8.
Figure 12:
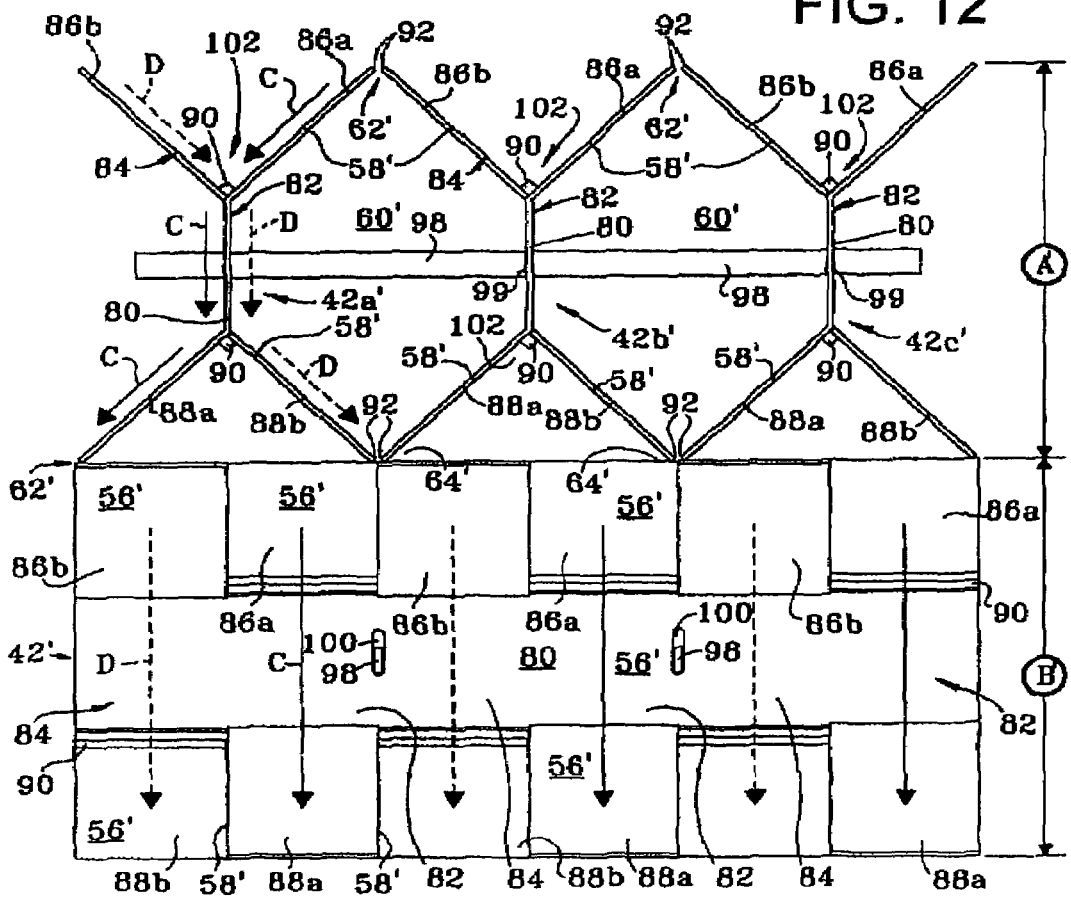
FIG. 12 is an elevational view of the structured packing of FIG. 11.

FIGS. 11 and 12 will be discussed together. FIG. 11 is a top plan view of two adjacent segments 82, 84 of three ribbons 42*a*', 42*b*', 42*c*'. FIG. 12 is an elevational view of two layers A', B' of ribbons 42'. The ribbons 42' in the top layer A' of FIG. 12 are designated ribbons 42*a*', 42*b*' and 42*c*'. The top tabs 86*a* of segments 82 in each ribbon 42*a*', 42*b*', 42*c*' all project from the standard strip 80 in parallel but angular to the top tabs 86*b* of segments 84. The bottom tabs 88*a* of segments 82 in each ribbon 42*a*', 42*b*', 42*c*' all project in parallel but angular to the bottom tabs 88*b* of segments 84. The top tabs 86*b* of segments 84 in each ribbon 42*a*', 42*b*', 42*c*' all project from standard strip 80 in parallel but angular to the top tabs 86*a* of segments 82. The bottom tabs 88*b* of segments 84 in each ribbon 42*a*', 42*b*', 42*c*' all project in parallel but angular to the bottom tabs 88*a* of segments 82. Opposing edges 92 of top tabs 86*a*, 86*b* stop short of each other to provide an imaginary peak 62' and opposing edges 92 of bottom tabs 88*a*, 88*b* stop short of each other to provide an imaginary valley 64'. The stabilizing strip 90 sits in the trough 102 defined by upper tabs 86 and lower tabs 88. A tie rod 98 extending through apertures 100 in the standard strip 80 secures all of the ribbons 42*a*', 42*b*', 42*c*' in an array. Notches 99 in the tie rod 98 may facilitate engagement with apertures 100. The tie rod 98 may be welded to the standard strip 80. In FIG. 12, layer A' is seen stacked on layer B'. Valleys 64' of ribbons 42*a*', 42*b*', 42*c*' in layer A' rest on peaks 62' of layer B'. Other or additional supports structures may be suitable. The orientation of layer A' is 90° to the orientation of layer B'. Solid arrow C shows a catalyst path down the obstructive faces 56' of segment 82 and dashed arrow D shows a catalyst path down obstructive faces 56' of segment 84. The axial spacing of a segment 82 of ribbon 42*a*' is offset from the axial spacing of segment 84 of ribbon 42*b*' which is offset from the axial spacing of segment 82 of ribbon 42*c*'. Consequently, opposing edges 58' of top tab 86*a* of segment 82 of ribbon 42*a*' and top tab 86*b* of segment 84 of ribbon 42*b*' and opposing edges 58' of bottom tab 88*b* of segment 84 of ribbon 42*a*' and bottom tab 88*a* of segment 82 may be parallel and may define a plane between opposing edges 58'. The opposing edges 58' of top tabs 86*a*, 86*b* and bottom tabs 88*b*, 88*a* of adjacent ribbons 42*a*', 42*b*' define openings 60' for the horizontal passage of fluid and catalyst. Opposing edges 58' of top tabs 86*a*, 86*b* and bottom tabs 88*a*, 88*b* of the same segments 82, 84 of the same ribbons 42*a*', 42*b*', 42*c*' define openings 61 for the vertical passage of catalyst.

The ribbons 42, 42' are typically formed from alloy steels that will stand up to the high temperature conditions in the reaction zone. The ribbons 42, 42' may be stacked in the stripping section 38 and by fixing in notches provided in a support structure. Other supports may be suitable.

EXAMPLE 1

The stripper embodiments of the present invention were evaluated for performance relative to ideal stripping performance. We constructed a test apparatus embodying the stripping arrangements of the present invention as shown in FIGS. 5-7, labeled Packing 1, and FIGS. 8-12, labeled Packing 2. The test apparatus comprised a cylinder having a 0.6 m (2 foot) diameter. Packing 1 occupied a vertical height of 2.3 m (7.5 feet) and Packing 2 occupied 2.2 m (7.2 feet). Overall, the height of the cylinder was 8 m (26.3 feet). The test apparatus was operated by circulating equilibrium FCC catalyst downwardly from a top inlet through the apparatus while air passed under the lowermost baffle upwardly through the baffles. The recovery of adsorbed hydrocarbons was simulated by injection of helium tracer into the circulating catalyst followed by measurement of the helium concentration in the recovered air. The stripped catalyst was recovered from the bottom of the test apparatus and the concentration was measured to determine the efficiency of the stripping operation. The air and helium along with entrained catalyst particles were recovered from the top of the apparatus and separated for recycle of the catalyst to the apparatus.

Figure 2:
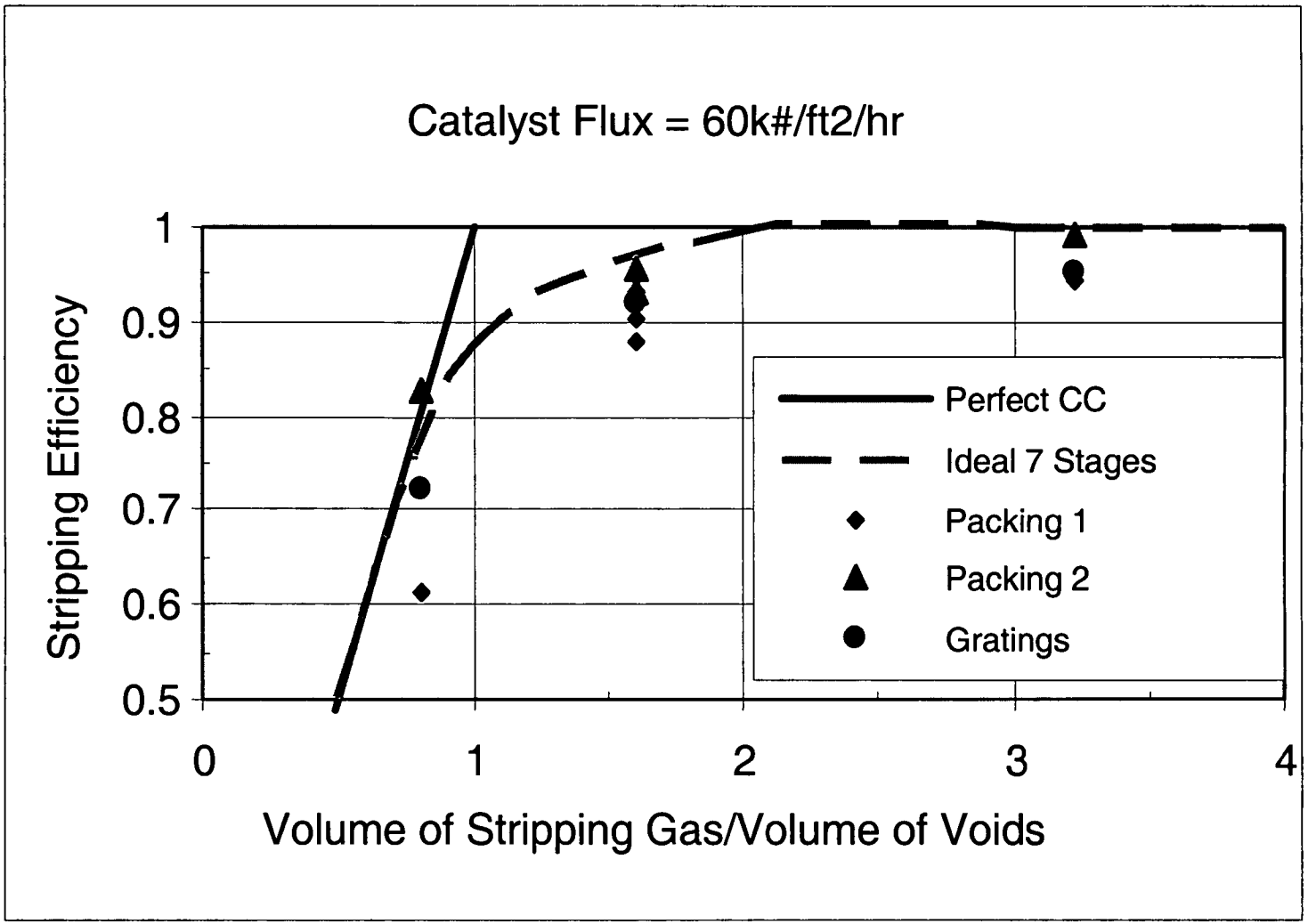
Figure 3:
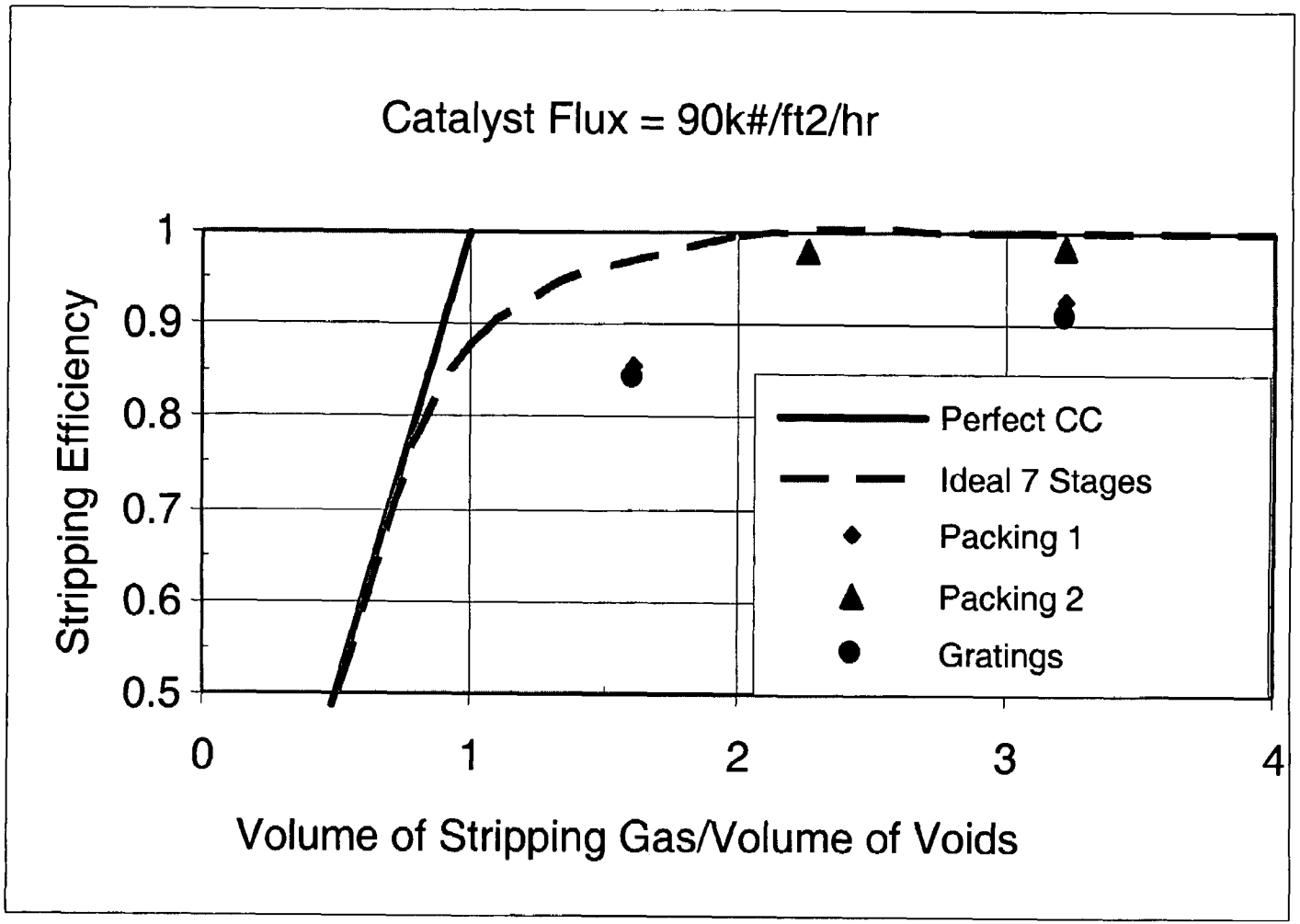

In FIGS. 1-3, performance of two embodiments of the present invention is compared to perfect counter-current performance and ideal backmixed, seven-stages performance at catalyst fluxes of 30,000, 60,000 and 90,000 lbs./ft.$^2$/hr. In FIGS. 1-3, stripping efficiency is the percentage of gas stripped from the catalyst, volume of stripping gas is the volume of stripping gas injected into the test stripper and volume of voids refers to the catalyst void volume. Packing 1 refers to the embodiment shown in FIGS. 5-7 and Packing 2 refers to the embodiment shown in FIGS. 8-12. Gratings refers to the stripping vessel comprising gratings with downcomers disclosed in U.S. Pat. No. 6,680,030 B2.

In FIGS. 1 and 2, Packing 2 performs as well as a perfect counter-current model at low volume of stripping gas/volume of voids ratio. In FIGS. 1-3, at higher volume of stripping gas/volume of voids ratios Packing 2 performs at least as well as the ideal seven back-mixed stages model. FIGS. 1 and 3 shows that Packing 1 performs just below Packing 2 and better than the gratings with downcomers in all but one exception in which two data points were obtained for gratings with downcomers.

What is claimed is:

1. An FCC stripping apparatus for stripping gaseous hydrocarbons from particulate material, said apparatus comprising:

a vessel containing a stripping section;

an entrance into the vessel for passing particles that contain hydrocarbons;

a structured packing in said vessel, said structured packing comprising a plurality of corrugated ribbons, each corrugated ribbon at least partially obstructing passage of the particles and having at least two faces angular to each other, and edges of adjacent ones said ribbons defining openings for the passage of particles;

a distributor for discharging a stripping fluid through said vessel; and a port in the vessel for receiving the stripped particles.

2. The apparatus of claim 1 wherein said plurality of ribbons are arranged in arrays comprising layers.

3. The apparatus of claim 1 wherein at least two of the layers have arrays in different orientations.

4. The apparatus of claim 3 wherein a first layer is stacked upon a second layer.

5. The apparatus of claim 1 wherein said two faces of said ribbon which are angular to each other both at least partially obstruct passage of the particles.

6. The apparatus of claim 1 wherein said ribbons comprise undulating peaks and valleys.

7. The apparatus of claim 6 wherein said valleys in an upper ribbon and peaks in a lower ribbon are secured proximate each other.

8. The apparatus of claim 1 wherein said ribbons comprise tabs secured to a standard section.

9. The apparatus of claim 8 wherein said ribbons comprise two tabs that are angular with each other and are both secured to said standard section.

10. The apparatus of claim 8 wherein said ribbons in a layer are secured in an array by a tie rod at said standard section.

11. The apparatus of claim 8 wherein said ribbons each include alternating segments with tabs in adjacent segments being angular to each other.

12. The apparatus of claim 1 wherein said ribbons include an obstructive strip the dimension of which can be varied to adjust the degree of obstruction to fluid flow.

* * * * *